US006527402B1

(12) United States Patent
Borri

(10) Patent No.: US 6,527,402 B1
(45) Date of Patent: Mar. 4, 2003

(54) PERFUME CONTAINER WITH SOUND OR LIGHT GENERATOR

(75) Inventor: Giovanni Borri, Roncopascolo (IT)

(73) Assignee: Henkel S.p.A., Ferentino (IT)

( * ) Notice: Subject to any disclaimer, the term of this patent is extended or adjusted under 35 U.S.C. 154(b) by 0 days.

(21) Appl. No.: 09/610,511

(22) Filed: Jul. 6, 2000

(30) Foreign Application Priority Data

May 16, 2000 (IT) ..... MI2000A001080

(51) Int. Cl.[7] ..... F21V 33/00

(52) U.S. Cl. ..... 362/86; 362/96; 362/101; 362/276; 362/802; 362/253; 362/154; 362/155

(58) Field of Search ..... 362/96, 101, 86, 362/186, 234, 276, 802, 253, 154, 155

(56) References Cited

U.S. PATENT DOCUMENTS 4,247,844 A * 1/1981 Zapolski et al. ..... 340/321
5,086,377 A * 2/1992 Roberts ..... 362/102
5,420,766 A * 5/1995 Hollis ..... 362/96
5,446,985 A * 9/1995 Chen ..... 42/1.08
5,662,406 A * 9/1997 Mattice et al. ..... 362/101
5,785,407 A 7/1998 Ratcliffe et al. ..... 362/101
5,941,629 A * 8/1999 Tuscher ..... 362/253
6,158,870 A * 12/2000 Ramirez

FOREIGN PATENT DOCUMENTS

| | | |
|---|---|---|
| DE | 29609902 | 9/1996 |
| DE | 29613250 | 11/1996 |
| DE | 19840748 | 3/2000 |
| FR | 2652264 | 3/1991 |
| FR | 2767515 | 2/1999 |
| WO | 0122399 | 3/2001 |

* cited by examiner

*Primary Examiner*—Sandra O'Shea
*Assistant Examiner*—Jacob Y. Choi
(74) *Attorney, Agent, or Firm*—Steinberg & Raskin, P.C.

(57) ABSTRACT

A perfume container (1) comprises a hollow casing (2) provided with an aperture (3) on which a closure element (6) is positioned, a spray dispenser (4) being possibly positioned on said aperture (3); the container (1) comprises sound and/or light generating means (10) controlled by activation means (14).

21 Claims, 2 Drawing Sheets

PERFUME CONTAINER WITH SOUND OR LIGHT GENERATOR

FIELD OF INVENTION

The present invention relates to a perfume container with a sound or light generator.

BACKGROUND OF THE INVENTION

Known perfume containers are of various forms and colours. They comprise a casing, possibly at least partly covered with a covering element, and provided with an aperture on which there is positioned a closure element involving either the whole upper part of the casing or only the aperture. In the first case, the closure element either comprises an aperture closure part or is in the form of a variously shaped hollow element, with a spray dispenser of known type being positioned on the aperture.

OBJECTS AND THE SUMMARY OF THE INVENTION

The casing can also be provided with a support base which can itself form part of the casing covering.

An object of this invention is to provide a perfume container with special features such as to draw the attention of a user, and which can offer to possible purchasers an inherent appeal plus an additional attraction (visual and/or audible) in general, and in particular related to the use of the perfume, these features adding to the quality of the perfume contained in it.

These and further objects which will be apparent to an expert of the art are attained by a perfume container in accordance with the accompanying claims.

The invention will be more apparent from the accompanying drawing, which is provided by way of nonlimiting example, and on which:

FIG. 1 is a schematic front view of a container of the

DETAILED DESCRIPTION OF THE INVENTION

Figure 1:
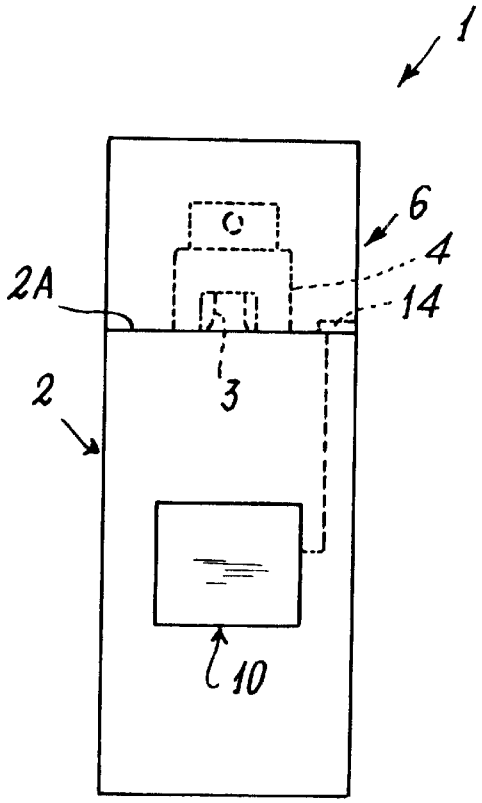
Figure 2:
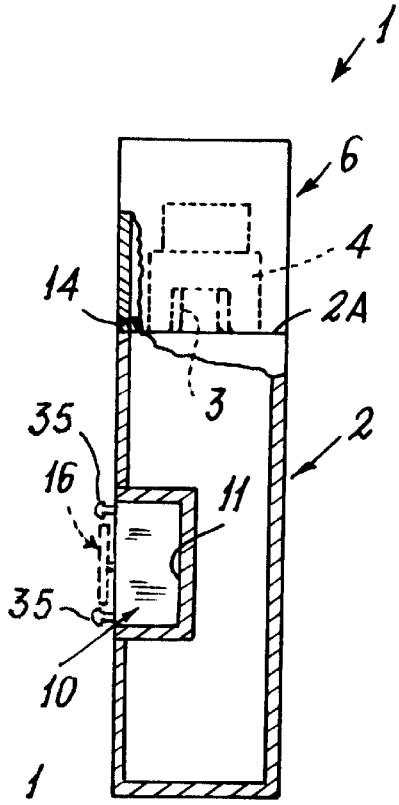
FIG. 2 is a partly sectional side view of the container of FIG. 1.

With reference to FIGS. 1 and 2, a container according to the invention is indicated overall by 1 and comprises a hollow casing 2 containing a perfume. This casing comprises an aperture 3 enabling the perfume to be used. In the figures, a usual member 4 for spray-dispensing the product contained in the casing 2 is shown positioned on the aperture 3.

The aperture 3 and the member 4 are covered by a closure or protection cap 6 fitted onto the casing 2 in known manner.

According to the invention, with the casting 2 there are associated means 10 for generating a sound (for example a musical motif) or a light signal, for example a light of particular color, of a type static or variable with time. The means 10 can be in particular a sound generator of any known type, either manually operated (carillon) or operated by an electronic circuit. These means can also or alternatively be one or more light emitters (LEDs and/or lamps) 35, of monochromatic or two or more color type, associated with known support, they being possibly activated at different times and advantageously defining a figure or symbol or symbols on the casing 2 when activated. In the case of LEDs and/or lamps or in the case of an electrically operated sound generator, the means 10 are powered electrically at low voltage.

In the example shown in FIGS. 1 and 2, the means 10 are positioned within a cavity or recess 11 provided directly in the casing 2, this latter being preferably of glass, but could at least partly be of any known plastic material. The means 10 are fixed into the recess 11 preferably by gluing.

If the means 10 are electrically powered, a battery 3 or another powering element is provided associated with the casing 2 and connected to said means. In the embodiment shown in the figures under examination, this battery (not shown) is preferably directly associated with the means 10 and is also inserted into the recess 11. A microswitch 14 or other control member for activating the means 10 is positioned on the casing 2. For example, the microswitch 14 can be positioned on that upper part 2A of the casing 2 on which the container 6 rests and is arranged to cooperate with this latter when this is positioned on the casing 2. The member 14 is connected in any known manner to the means 10 and to the battery 13 or, better still, is connected to the electrical power circuit (not shown) of the means 10. For example, said connection (indicated by 14 in FIG. 1) can be made via a printed electric circuit provided on the casing 2 and protected in known manner (for example by a plastic coating) to prevent any contact with the user using the perfume.

The microswitch or member 14 maintains the electric circuit connecting the battery to the means 10 "open" when the closure element is positioned on the casing 2. This is achieved by the closure element simply pressing against said member. When the element 6 is removed to enable the perfume to be used, its separation from the member 14 closes the electric circuit powering the means 10, to hence activate these latter.

If the means 10 comprise a manually operated sound generator, an attractive operating member 16 is associated with these means.

Figure 3:
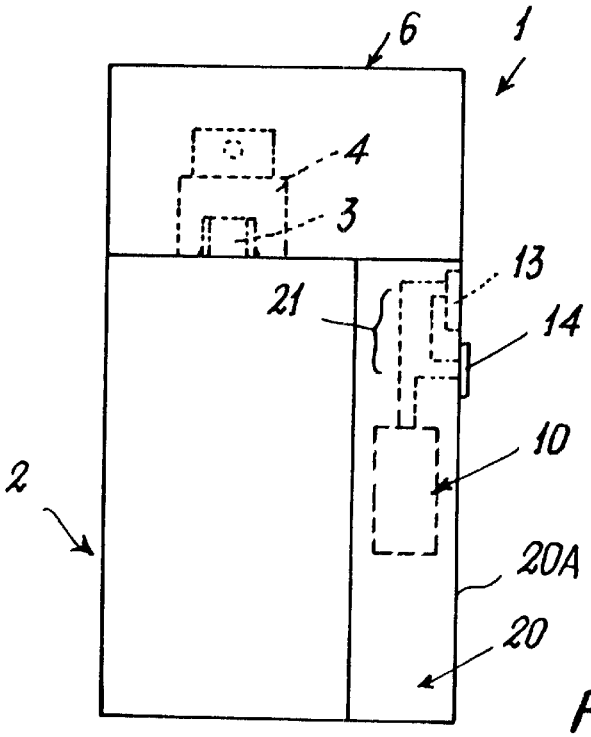
FIG. 3 is a front view of a different container according to the invention.

A first variant of the invention is shown in FIG. 3, in which parts corresponding to those already described are indicated by the same reference numerals. In the variant of FIG. 3, the means 10 are positioned in an housing 20 to the side of the casing 2. The housing 20 can be totally independent of the casing 2, being for example in the form of a box to be fixed to the casing by gluing. Alternatively, the housing 20 can be a covering portion of the casing 2 and be molded onto this latter. In both cases, the housing 20 contains the means 10, the element for their electrical powering (the battery 13) and the electric circuit connecting this latter to said means (all shown schematically at 21 in FIG. 3). The microswitch or control member 14, positioned on a (lateral) surface 20A of the housing 20, is connected into this circuit.

In the embodiment shown in FIG. 3, activation of the means 10 does not depend on separating the protection cap 6 from the casing 2 nor on using the perfume contained in the casing 2. Preferably the circuit 21 comprises a usual timer (not shown) which cuts power supply to the means 10 a predetermined time after their activation, independently of any operation of the microswitch 14.

Figure 4:
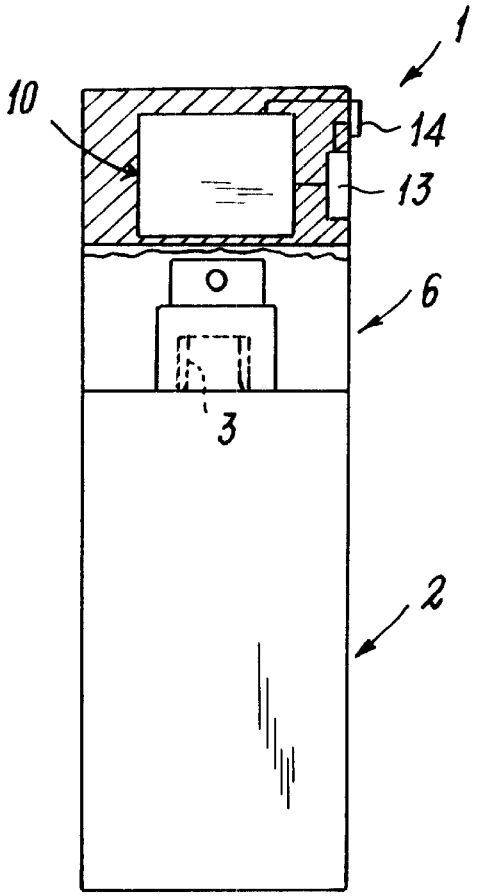
FIG. 4 is a partly sectional front view of a further different container according to the invention.

Another variant of the invention is shown in FIG. 4, in which parts corresponding to those of the already described figures are indicated by the same reference numerals. In FIG. 4, the means 10 are associated with the closure or protective cap 6. With this latter there are also associated the battery 13 and the member 14 for controlling the activation of the means 10. Again in the embodiment shown in FIG. 4, activation of the means 10 does not depend on using the perfume contained in the casing 2.

Figure 5:
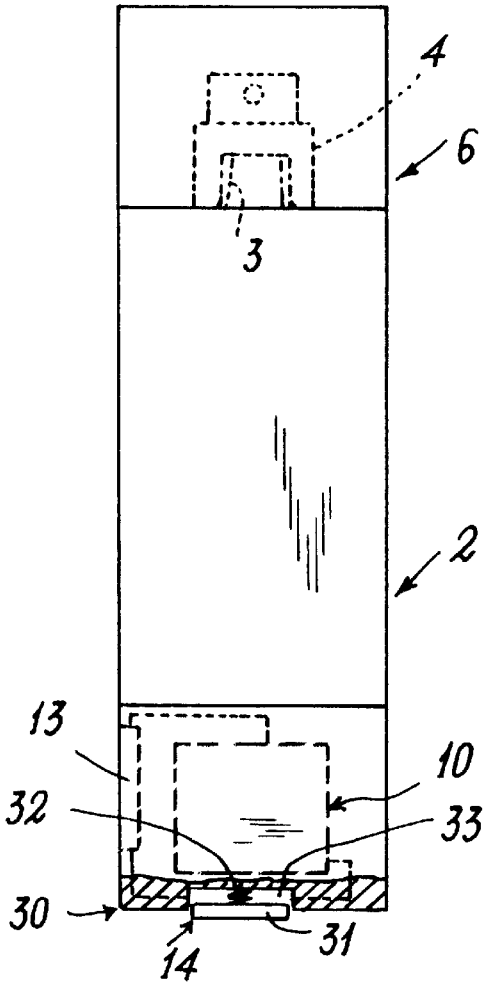
FIG. 5 is a partly sectional front view of yet a further different container according to the invention.

FIG. 5, in which parts corresponding to those of the already described figures are indicated by the same reference numerals, shows a further embodiment of the invention. In this embodiment, a base 30 is associated with the casing 2, for example by being glued to the casing or by forming part of its covering. The base contains the means 10, the electric circuit for their powering, the battery 13 and the member 14 for controlling activation of the means 10. These latter comprise an element 31 movable against an elastic return member 32 positioned in a seat 33 provided in the base 30. When in its rest position, the member 32 is inserted into the seat 33, in which position it "opens" the electric circuit powering the means 10. This rest position is attained when the casing 2 and its base 30 rest on a surface. When in its working position shown in FIG. 5, the member 32 emerges from the seat 33, to electrically power and hence activate the means 10. This position is attained when the casing is lifted from the surface. This position and hence the activation of the means 10 are linked to the use of the perfume by a user.

Any element provided for electrically powering the means 10 could be of replaceable type, in which case it would be positioned in a corresponding seat (provided in the means 10, in the element 20, in the element 6 or in the base 30) closed by a removable cover.

The means 10 could also comprise both the sound generating means (for example of electronic type with electronic musical modules arranged to emit music which can relate to the type of user for which the perfume is intended, for example a child) and the light generating means.

What is claimed is:

1. A perfume container (1) comprising:

a hollow casing (2) provided with an aperture (3);

a closure element (6) positioned on said aperture;

a spray dispenser (4) being positioned on said aperture (3), said container (1) comprising one of sound and light generating means (10) controlled by activation means (14); and wherein the activation means (14) is a switch interposed between the container casing (2) and the closure element (6).

2. A container as claimed in claim 1, characterised in that the sound generating means (10) are of mechanically operated type, such as a carillon.

3. A container as claimed in claim 1, characterised in that the sound generating means (10) are of electronic type and comprise at least one electronic musical module, said means being powered electrically by an electrical energy source (13) associated with the container.

4. A container as claimed in claim 1, characterised in that the light generating means (10) are at least one light emitting diode (LED) and/or a lamp, these being electrically powered.

5. A container as claimed in claim 4, characterised by comprising a plurality of LEDs and/or lamps.

6. A container as claimed in claim 4, characterised in that the plurality of LEDs and/or lamps define a precise shape.

7. A container as claimed in claim 5, characterised in that the LEDs and/or lamps of the plurality of LEDs and/or lamps are activated separately and sequentially.

8. A container as claimed in claim 3, characterised in that the electrical power source is a battery (13).

9. A container as claimed in claim 8, characterised in that the battery is removable.

10. A container as claimed in claim 8, characterised in that the battery is inserted into the sound and/or light generating means.

11. A container as claimed in claim 1, characterised in that the sound and/or light generating means (10) are inserted into a seat (11) provided in the container casing (2).

12. A container as claimed in claim 1, characterised in that the sound and/or light generating means (10) are inserted into the closure element (6).

13. A container as claimed in claim 1, characterised in that the sound and/or light generating means (10) are inserted into an element (20, 30) associated with the container casing (2).

14. A container as claimed in claim 13, characterised in that the element (20) is associated with one side of the container casing (2).

15. A container as claimed in claim 13, characterised in that the element (30) is associated with the bottom of the casing (2) and acts as the base for this latter.

16. A container as claimed in claim 13, characterised in that the element (20, 30) containing the sound and/or light generating means is moulded onto the container casing (2).

17. A container as claimed in claim 1, characterised in that the activation means (14) are a switch interposed between the container casing (2) and the closure element (6).

18. A container as claimed in claim 1, characterised in that the activation means (14) are a switch associated with the closure element (6).

19. A container as claimed in claim 1, characterised in that the activation means (14) are a switch carried by the element associated with the container casing (2).

20. A container as claimed in claim 15, wherein the activation means (14) is a switch associated with the lower part of the element (30) acting as the base of the container casing (2), and the switch is structured and arranged to activate one of a sound and light generating means upon a lifting the casing (2) from a support surface.

21. A container as claimed in claim 1, characterised by comprising a timer member for automatically deactivating the sound and/or light generating means a predetermined time after their activation.

* * * * *